United States Patent [19]

Kranefeld et al.

[11] Patent Number: 4,796,335

[45] Date of Patent: Jan. 10, 1989

[54] METHOD AND APPARATUS FOR OPENING FIBER BALES

[75] Inventors: Andreas Kranefeld, Erkelenz; Josef Temburg, Jüchen, both of Fed. Rep. of Germany

[73] Assignee: Trützschler GmbH & Co. KG, Monchen Gladbach, Fed. Rep. of Germany

[21] Appl. No.: 135,523

[22] Filed: Dec. 17, 1987

[30] Foreign Application Priority Data

Dec. 19, 1986 [DE] Fed. Rep. of Germany ..... 3643507

[51] Int. Cl.[4] ..... D01G 7/04

[52] U.S. Cl. ..... 19/80 R; 19/81

[58] Field of Search ..... 19/80 R, 81

[56] References Cited

U.S. PATENT DOCUMENTS 2,509,823 5/1950 Hughes ..... 19/80 R
4,297,767 11/1981 Leifeld ..... 19/80 R
4,554,708 11/1985 Leifeld et al. ..... 19/81 X

FOREIGN PATENT DOCUMENTS 2819292 11/1979 Fed. Rep. of Germany .
0764137 12/1956 United Kingdom .

*Primary Examiner*—Louis K. Rimrodt
*Attorney, Agent, or Firm*—Spencer & Frank

[57] ABSTRACT

A bale opener has an opening device arranged for a horizontal back-and-forth travel above a row of fiber bales. The opening device includes two parallel-arranged and horizontally oriented opening rollers provided with teeth. The opening rollers are spaced from one another in a direction parallel to the direction of back-and-forth travel and each opening roller has an axis of rotation oriented perpendicularly to the direction of the back-and-forth travel. The opening device further has a bale hold-down device through which the teeth of the opening rollers project for penetrating into upper faces of the bales and a suction device for removing fiber tufts detached by the opening rollers. The opening rollers are codirectionally rotated during the back-and-forth travel of the bale opener.

15 Claims, 5 Drawing Sheets

METHOD AND APPARATUS FOR OPENING FIBER BALES

BACKGROUND OF THE INVENTION

This invention relates to a method and an apparatus for opening fiber bales by means of two rapidly rotating fiber detaching devices, such as sawtooth rollers which are arranged above a row of freely standing fiber bales and which travel back and forth while the teeth of the opening devices project through a bale holding device such as a grate and penetrate into the fiber bales. The opening device detaches the fiber tufts from the bale surface and hurls them away therefrom. A suction device is provided to withdraw the fiber detached and thrown by the opening device.

U.S. Pat. No. 3,208,107 discloses a bale opener in which an opening device is moved up and down laterally at the fiber bales. The fiber tuft detaching device has two opening rollers provided with teeth which project through grate bars and remove fiber tufts from the bales. The direction of rotation of both opening rollers is, at the bale surface, directed inwardly, that is, towards one another. It is a disadvantage of this arrangement that the opening rollers work on the fiber bale surface with different orientation of the detaching teeth, that is, each opening roller works on the fiber bale in a direction which is opposite to the direction of orientation of its teeth.

SUMMARY OF THE INVENTION

It is an object of the invention to provide an improved apparatus and method with which the above-noted disadvantages are eliminated and which, in particular, ensure a uniform removal of fiber material from the bale surface.

This object and others to become apparent as the specification progresses, are accomplished by the invention, according to which, briefly stated, the rotation of the opening rollers is codirectional in either travelling direction thereof.

By virtue of identical directions of rotation both opening rollers engage the bale surface in the same direction of motion (travelling motion in the forward and rearward directions). In this manner there is achieved a uniform removal of the fiber tufts from the bale faces. The direction of rotation of one opening roller is the same as that of the other opening roller during either direction of travel.

Preferably, the direction of rotation of the opening rollers is, at the bale surface, oriented against the direction of the travel of the bale opener. In this manner a gentle engagement of the bale faces by the opening rollers is achieved. The result is a clean, well-defined bale surface. In particular, undesired shifts of the fiber material layers in the fiber bale are avoided. Furthermore, the quantity of fiber tufts which revolve with the opening rollers is diminished and also, the operational noises are reduced. Further, an escape of the fiber tuft stream at the end of the fiber bales is avoided. Also, an alternating grate, that is, a grate construction which is shifted parallel to the axis of the opening rollers every time the bale opener changes direction in order to eliminate undesired crests and valleys in the fiber bale may be dispensed with.

It may be, however, expedient to provide a direction of rotation of the opening rollers which, at the fiber bale surface, is codirectional with the travelling direction of the bale opener.

Advantageously, during forward or reverse travel, only one opening roller is driven while the other opening roller is idling. As a result, about the idling opening roller no air streams are generated which would exert a braking effect on the fiber tufts removed by the fast rotating opening rollers. Since the peripheral speed of the idling opening roller is essentially identical with the travelling speed of the bale opener, while pressing down on the bale face, it functions as a pressing, supporting and retaining roller for the bales and the bale layers. Preferably, the teeth of the fast rotating opening roller are, in the zone of the bale face, oriented opposite the travelling direction of the bale opener. In this manner, there is achieved a thorough and, at the same time, a gentle engagement of the working opening roller into the bale face. Preferably, each opening roller has an overrunning clutch, or the like. In this manner, a reversal of the rotary direction, for example, from an idling co-travel to a fast rotating drive and conversely is achieved in a structurally simple manner.

Expediently, both opening rollers are driven rollers. According to a preferred embodiment of the invention, one opening roller is driven at high speed while the other is driven such that its peripheral speed approximately corresponds to that of the opener travel. In this manner, the rpm of both opening rollers may be set and controlled separately or as a unit.

Preferably, in an alternating manner, one or the other opening roller may be rapidly driven each time the other opening roller is driven at low rpm's or is an idling roller. Preferably, the direction of rotation of the opening rollers may be reversed. In this manner, two working directions may be obtained.

According to a further feature of the invention, between the opening rollers and the fiber tuft removing (suction) device there is provided reversible air guide baffle whose axis of rotation is arranged in a zone above the opening rollers. In this manner, the suction air stream is concentrated each time at that opening roller which performs the fiber tuft detaching work.

The invention also concerns an advantageous method for using the apparatus according to the invention wherein the opening device in one pass in one direction removes fiber tufts from the bale surface and thereafter, the opening device is returned above the bale face in the opposite direction without fiber tuft removal, preferably in a fast travel and thereafter again travels in the working direction and removes fiber tufts, whereby alternatingly in the one pass one opening roller rotates against the direction of travel and in the other pass the other opening roller is driven with high speed in the direction of travel. As a result of this arrangement, in case of a fiber tuft removal of different types of material, the sequentially removed mixture always remains the same, that is, for each pass over the entire fiber bale rows always the same mixture is removed. This is of advantage, for example, when cotton fibers of different types or mixtures of cotton fibers and artificial fibers are detached from the bales.

DESCRIPTION OF THE PREFERRED EMBODIMENTS

Figure 1A:
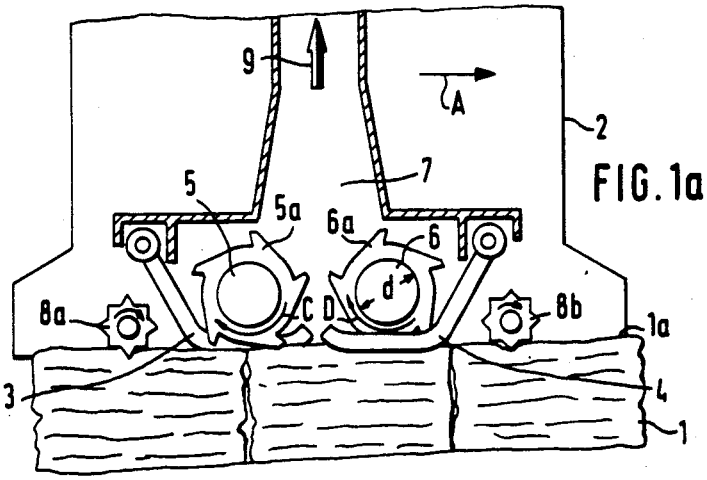
FIGS. 1*a* and 1*b* are schematic side elevational views, partially in section, of a preferred embodiment of the invention illustrating opening rollers which rotate, in the working zone, in a direction opposite to the momentary direction of travel.
Figure 1B:
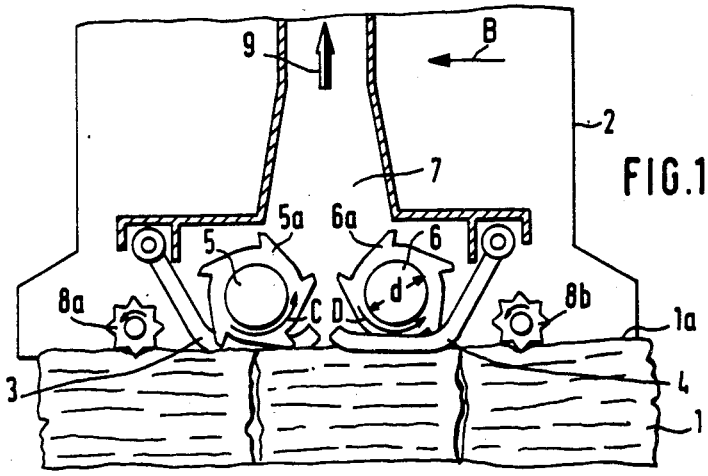

Turning to FIGS. 1*a* and 1*b*, there is schematically shown a part of a bale opener in engagement with the top face of fiber bales 1 supported on the room floor in a freestanding manner. The bale opener may be a "BLENDOMAT BDT" model manufactured by Trutzschler GmbH & Co. KG, Monchengladbach, Federal Republic of Germany. The fiber bales are situated along rails on which the bale opener carriage (not shown) may travel back and forth. The bale opening device proper may be vertically moved to adapt to the height of the fiber bales.

The opening device has a housing 2, two grates 3 and 4, two opening rollers 5 and 6 and a hood 7, the latter forming part of a suction device. The bale opener travels in the direction A (FIG. 1*a*) or B (FIG. 1*b*). The grate bars forming the respective grates 3 and 4 are situated in the axial clearance between adjoining circumferential rows of teeth 5*a*, 6*a* underneath the opening rollers 5 and 6 as also shown, for example, in FIG. 5. During operation the grates 3, 4 lie on the upper face 1*a* of the fiber bales 1 and thus the grates serve as hold-down devices.

Upstream and downstream of the opening rollers 5, 6 there are arranged axially parallel pressing rollers 8*a*, 8*b* which press down on the upper face 1*a* of the fiber bales 1 and the teeth of which penetrate into the bale surface. In this manner the fiber bales 1 are immobilized and thus secured against shifting or tipping over. Further, the layers in the fiber bales 1 are secured against a horizontal tear-off caused by the opening rollers 5, 6 or against shifts caused by the grates 3, 4.

The direction of rotation of the opening rollers 5, 6, indicated by the arrows C and D, respectively, is in the zone of the upper face 1*a* of the fiber bales 1 oriented against the direction of travel A shown in FIG. 1*a* and directed against the travelling direction B shown in FIG. 1*b*.

The fiber tuft suction hood 7 is arranged above the opening rollers 5, 6. In operation, the opening device travels with the opening rollers 5, 6 above the freely supported fiber bales 1 back and forth. During such travel the teeth 5*a*, 6*a* of the respective opening rollers 5 and 6 project through the gaps between adjoining grate bars of the grates 3 and 4 and penetrate into the bale face 1*a*. The fiber tufts detached from the surface 1*a* of the fiber bales 1 are hurled away from the opening rollers 5, 6 and are immediately introduced into the air stream 9 and are moved away by suction through the suction hood 7.

In the operational phase shown in FIG. 1*a* (forward travel, direction A), the leading opening roller 6 is rotated at high speed by a drive motor (not shown) and detaches fiber tufts from the fiber bales 1. The teeth 6*a* of the opening roller 6 are oriented in the direction of rotation D. The direction of rotation D of the opening roller 6 is, in the zone of the upper face la of the fiber bales 1 oriented against the travelling direction A The trailing opening roller 5 whose teeth 5*a* are oriented against the rotary direction C idles and thus does not detach any fiber tufts from the fiber bales. The direction of rotation C of the opening roller 5 is, in the zone of the upper face 1*a* of the fiber bales 1, oriented against the travelling direction A. The opening roller 5 drags on the bale surface 1*a* and thus rotates with the same circumferential speed as the travelling speed of the bale opener.

In the operational phase shown in FIG. 1*b* (return travel, direction B) the leading opening roller 5 is rotated rapidly by a drive motor and detaches fiber tufts from the bales 1. The teeth 5*a* of the opening roller 5 are oriented in the rotary direction C which, in the zone of the upper face 1*a* of the fiber bales 1 is oriented against the travelling direction B. The trailing opening roller 6 whose teeth 6*a* are oriented against the rotary direction D idles and thus does not detach any fiber tufts from the fiber bales. The rotary direction D of the opening roller 6 in the zone of the upper face la of the fiber bales 1 is oriented against the travelling direction B. The opening roller 6 drags on the bale surface 1*a* and thus has a circumferential speed which is identical to the travelling speed of the bale opener.

In operation, the apparatus according to FIGS. 1*a*, 1*b* detaches fiber tufts from the bales 1 sequentially in both travelling directions A and B. There is obtained a good, clean bale surface. Particularly, an undesirable shift of fiber material layers is avoided. Further, the quantity of fiber tufts revolving with the opening rollers 5 and 6 is reduced. Also, it is an advantage of this arrangement that the operational noises are reduced. Further, an escape of fiber tufts at the ends of the fiber bale row is avoided. Furthermore, a reciprocating grate which changes position every time the fiber bale opener reverses travelling direction (for avoiding crests and valleys in the fiber bale) may be dispensed with.

Figure 2A:
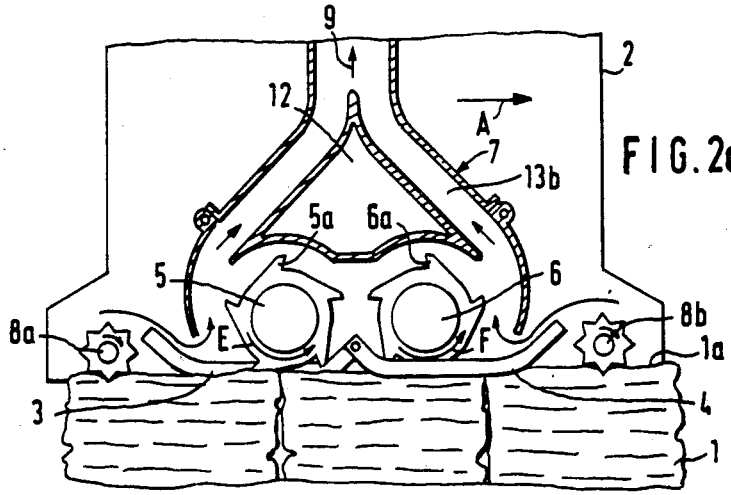
FIGS. 2*a* and 2*b* are schematic side elevational views of another preferred embodiment of the invention illustrating opening rollers which rotate, in the working zone, codirectionally with the momentary direction of travel.
Figure 2B:
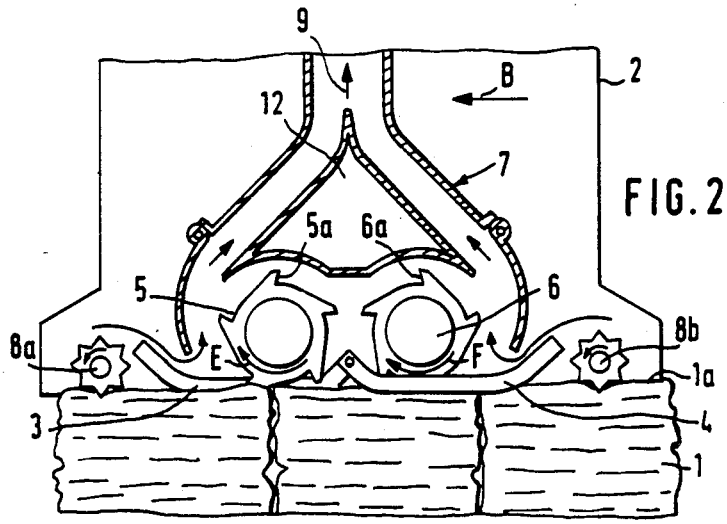

Turning now to FIGS. 2*a* and 2*b*, the direction of rotation E, F of the opening rollers 5 and 6 is, in each instance, codirectional with the travelling direction A and B, respectively. In other aspects, as concerns the driven and idling opening roller, the same applies as in the construction described in conjunction with FIGS. 1*a*, 1*b*.

Figure 3:
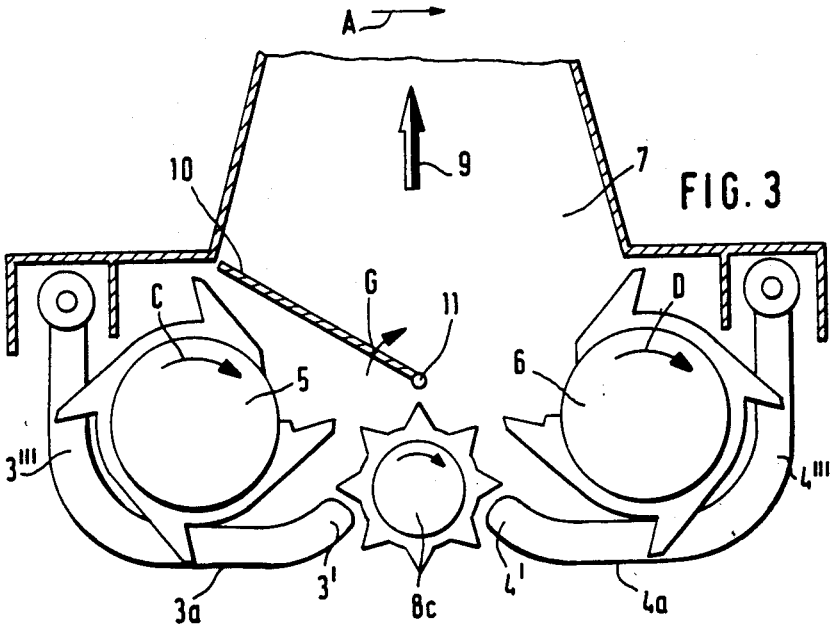
FIG. 3 is a schematic side elevational view of still another preferred embodiment of the invention.

Turning to FIG. 3, there is shown an embodiment in which between the opening rollers 5, 6 and between the ends of the grates 3, 4 there is arranged a pressing roller 8*c*. Between the opening rollers 5, 6 and the suction hood 7 there is arranged a reversible air guiding baffle plate 10 which is pivotally secured at 11 at a location above the pressing roller 8*c* and is rotatable in the direction of the arrow G. The guide plate 10 may be switched from a position (not shown) above the opening roller 6 into a position shown in FIG. 3. During the travel in the direction A the guide plate 10 is in its position shown in FIG. 3 so that the suction air stream 9 is concentrated on the fiber tufts detached by the leading opening roller 6. At the same time, the zone above the idling or slowly driven trailing opening roller 5 is shielded by the guide plate 10.

Figure 4:
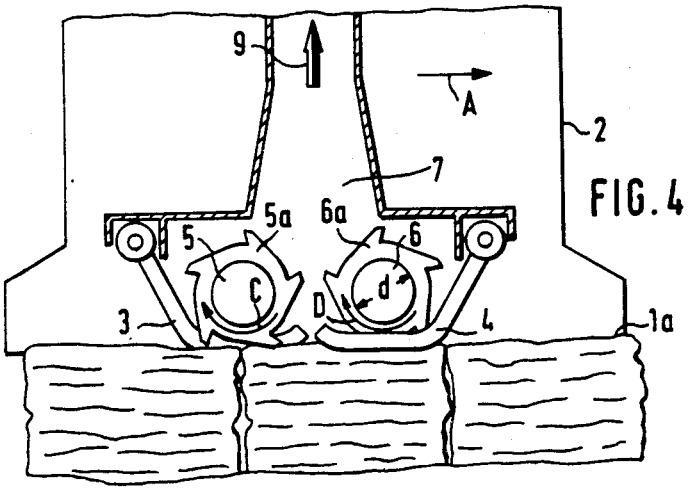
FIG. 4 is a schematic side elevational view, partially in section, of a further preferred embodiment, wherein the slowly rotating opening roller functions as a hold-down component.

Turning to FIG. 4, the pressing rollers 8*a*, 8*b* and 8*c* shown in the construction illustrated in FIGS. 1*a*, 1*b*, 2, 2*b* and 3 are omitted. The idling opening roller 5 is, by virtue of being pressed onto the upper face 1*a* of the bales 1, functioning as a support roller ensuring that the bales 1 will not tip over. The idling opening roller also serves as a hold-back roller against a shifting of the layers in the bales 1.

Figure 5A:
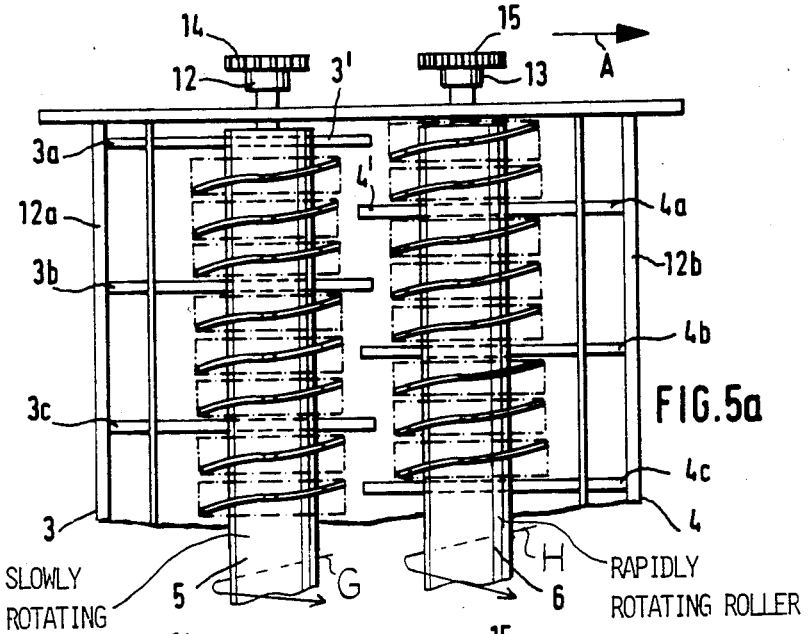
FIGS. 5*a* and 5*b* are schematic top plan views of still another preferred embodiment which executes working passes only in one direction.
Figure 5B:
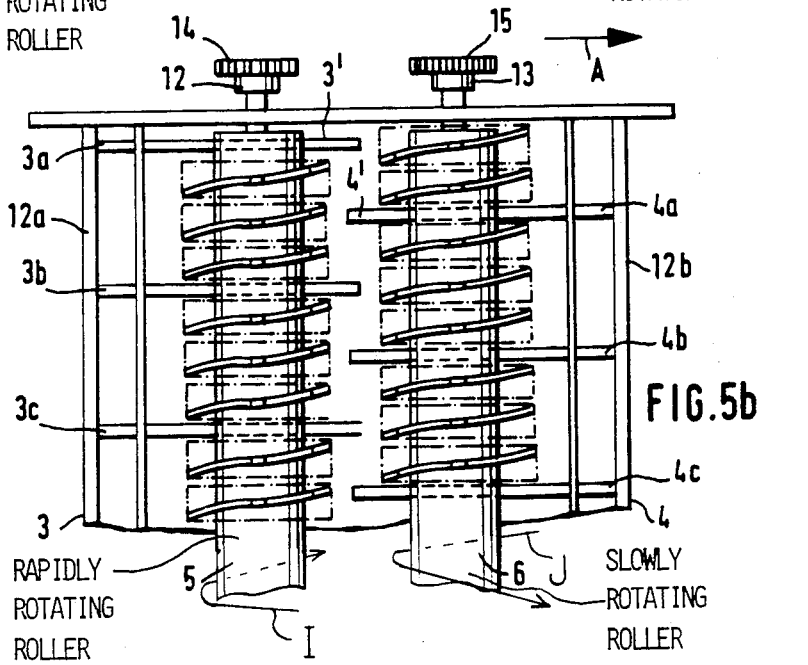

According to FIGS. 5*a* and 5*b*, the grates 3, 4 are formed each of a plurality of grate bars 3*a*, 3*b*, 3*c* and 4*a*, 4*b*, 4*c*. The ends 3', 4' are open (free standing) whereas at the opposite ends the grate bars are secured to holding elements 12*a*, 12*b*. Each opening roller 5, 6 has its own grate 3 or 4, respectively; the open ends 3', 4' of the respective grate bars 3*a*–3*c* and 4*a*–4*c* are oriented towards one another. The grate bars 3*a*–3*c* and 4*a*–4*c* of the grates 3 and 4 extend parallel to one another over the width of the surface 1*a* of the fiber bales. Between the grate bars 3*a*–3*c* and 4*a*–4*c* there are schematically shown the opening rollers 5, 6; the effective zone of their teeth 5*a*, 6*b* working on the upper face 1*a* during rotation is shown in phantom lines. The grate bars 3*a*–3*c* and 4*a*–4*c* are arranged offset with respect to one another.

Between the opening rollers 5, 6 and the associated drive elements such as gears 14, 15 there is arranged a respective overrunning clutch 12 and 13. The overrunning clutches 12 and 13 provide that the drive motor rotates the opening rollers 5 and 6 in one direction at a high rpm whereas in the other direction they do not transmit any torque to the opening rollers 5, 6. During operation the device removes fiber tufts from the bale faces in one pass in the travelling direction A and subsequently, the bale opener travels above the bale faces in the opposite direction (against the travelling direction A) without detaching fiber tufts and subsequently, it again works on the fiber bales in the direction A. Thus, working passes are performed only in direction A whereas idling passes occur in the opposite direction of travel. In subsequent working passes (travel in direction A) alternatingly the one opening roller 6 is rotated rapidly against the direction of travel A (FIG. 5*a*) and in the other pass (FIG. 5*b*), the other opening roller 5 is rotated rapidly in the travelling direction A. In one pass according to FIG. 5*a* the opening roller 5 runs idle and in the other pass according to FIG. 5*b* the opening roller 6 idles whereby the speed of the idling run is equal to the travelling speed by virtue of the overrunning clutches 12 and 13. The respective directions of rotation of the opening rollers 5 and 6 in FIGS. 5*a* and 5*b* are designated at G, H, I and J.

Figure 6:
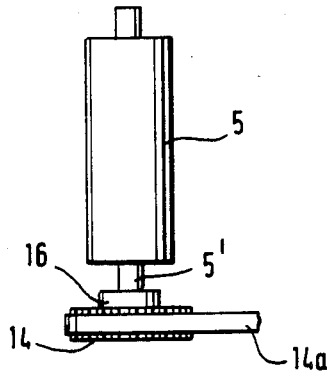
FIG. 6 is a top plan view showing further details of a component of the preferred embodiments.

In FIG. 6 between the stub shaft 5' of the opening roller 5 and a belt sprocket 14 there is provided a clutch 16. The toothed belt is designated at 14*a*. By virtue of the clutch 16 it is feasible to selectively apply the torque of the drive motor (not shown) to or remove its torque from the opening roller 5, while the drive motor may run continuously. The opening roller 6 may be provided with the same type of clutch and drive arrangement as the opening roller 5.

The present disclosure relates to subject matter contained in Federal Republic of Germany patent application No. P 36 43 507.4 (filed Dec. 19, 1986) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a bale opener having an opening device arranged for a horizontal back-and-forth travel above a row of fiber bales; said opening device having two parallel-arranged and horizontally oriented opening rollers provided with teeth; said opening rollers being spaced from one another in a direction parallel to the direction of back-and-forth travel; each said opening roller having an axis of rotation oriented perpendicularly to the direction of the back-and-forth travel; said opening device further having a bale hold-down device through which the teeth of the opening rollers project for penetrating into upper faces of the bales and suction means for removing fiber tufts detached by said opening rollers; the improvement comprising means for codirectionally rotating said opening rollers during said back-and-forth travel.

2. A bale opener as defined in claim 1, further comprising torque-exerting means for so rotating said opening rollers that in a working zone adjacent the bale faces said opening rollers turn in a direction opposite to the direction of momentary travel of the opening device.

3. A bale opener as defined in claim 1, further comprising torque-exerting means for so rotating said opening rollers that in a working zone adjacent the bale faces said opening rollers turn in a direction identical to the direction of momentary travel of the opening device.

4. A bale opener as defined in claim 1, wherein the opening rollers are alternatingly leading and trailing opening rollers as viewed in the direction of momentary travel of the opening device; further wherein said torque exerting means comprises a motor means for rapidly rotating the leading opening roller; said torque-exerting means comprising a frictional interaction between the bale face and the trailing opening roller for rotating the trailing opening roller as an idler with a peripheral speed equalling the travelling speed of the opening device.

5. A bale opener as defined in claim 1, wherein the opening rollers are alternatingly rapidly rotated leading rollers and slowly rotated trailing rollers as viewed in the direction of momentary travel of the opening device; the teeth of the rapidly rotated leading roller are, in a working zone adjacent the bale faces, oriented in a direction opposite to the direction of momentary travel of said opening device.

6. A bale opener as defined in claim 1, further comprising a separate overrunning clutch means operatively connected with each said opening roller.

7. A bale opener as defined in claim 1, further comprising motor means for driving both said opening rollers.

8. A bale opener as defined in claim 1, said motor means including means for rapidly rotating one of said opening rollers and for rotating the other opening roller at a peripheral speed approximately corresponding to the speed of travel of the opening device.

9. A bale opener as defined in claim 8, further comprising means for reversing the direction of rotation of the opening rollers.

10. A bale opener as defined in claim 1, further comprising an air guide baffle pivotally supported between said opening rollers and being arranged to assume selected pivotal positions; in one of said pivotal positions said guide baffle shielding one of said opening rollers from an airstream generated by said suction means and in another of said pivotal positions said guide baffle shielding the other of said opening rollers from an airstream generated by said suction means.

11. A method of operating a bale opener having an opening device arranged for a horizontal back-and-forth travel above a row of fiber bales; said opening device having two parallel-arranged and horizontally oriented opening roller provided with teeth; said opening rollers being spaced from one another in a direction parallel to the direction of back-and-forth travel; each said opening roller having an axis of rotation oriented perpendicularly to the direction of the back-and-forth travel; said opening device further having a bale hold-down device through which the teeth of the opening rollers project for penetrating into upper faces of the bales and suction means for removing fiber tufts detached by said opening rollers; including the steps of propelling the opening device to perform back-and-forth travel; rotating the opening rollers for removing fiber tufts from the upper bale faces and removing the detached fiber tufts by suction; the improvement comprising the step of codirectionally rotating said opening rollers during said back-and-forth travel.

12. A method as defined in claim 11, further wherein the step of rotating comprises the step of so rotating said opening rollers that in a working zone adjacent the bale faces said opening rollers turn in a direction opposite to the direction of momentary travel of the opening device.

13. A method as defined in claim 11, further wherein the step of rotating comprises the step of so rotating said opening rollers that in a working zone adjacent the bale faces said opening rollers turn in a direction identical to the direction of momentary travel of the opening device.

14. A method as defined in claim 11, wherein the opening rollers ar alternatingly leading and trailing opening rollers as viewed in the direction of momentary travel of the opening device; further wherein the step of rotating comprises the steps of rapidly rotating the leading opening roller and rotating the trailing opening roller as an idler with a peripheral speed equalling the travelling speed of the opening device.

15. A method as defined in claim 11, further comprising the steps of performing working passes solely in one direction of the back-and-forth travel; performing idling passes in the other direction of the back-and-forth travel; during consecutive working passes alternatingly driving, with fast rotation, the one and the other opening roller such that in one working pass the one opening roller moves in the working zone codirectionally with the direction of the momentary travel of the opening device and in a consecutive working pass the other opening roller moves in the working zone in a direction opposite to the direction of the momentary travel of the opening device.

* * * * *